US009353983B2

(12) United States Patent
Mitchell et al.

(10) Patent No.: US 9,353,983 B2
(45) Date of Patent: May 31, 2016

(54) REFRIGERATOR APPLIANCE WITH VARIABLE TEMPERATURE COMPARTMENT

(71) Applicant: General Electric Company, Schenectady, NY (US)

(72) Inventors: Alan Joseph Mitchell, Louisville, KY (US); Joel Erik Hitzelberger, Louisville, KY (US); Ronald Gary Foster, Louisville, KY (US)

(73) Assignee: General Electric Company, Schenectady, NY (US)

( * ) Notice: Subject to any disclaimer, the term of this patent is extended or adjusted under 35 U.S.C. 154(b) by 251 days.

(21) Appl. No.: 14/061,125

(22) Filed: Oct. 23, 2013

(65) Prior Publication Data

US 2015/0107285 A1 Apr. 23, 2015

(51) Int. Cl.

*F25D 17/06* (2006.01)
*F25D 23/04* (2006.01)
*F25D 11/02* (2006.01)

(52) U.S. Cl.

CPC ..... *F25D 17/065* (2013.01); *F25D 23/04* (2013.01); *F25D 11/02* (2013.01); *F25D 2317/061* (2013.01); *F25D 2317/062* (2013.01); *F25D 2317/0666* (2013.01); *F25D 2323/021* (2013.01)

(58) Field of Classification Search

CPC ..... F25D 11/02; F25D 17/065; F25D 23/02; F25D 23/025; F25D 23/04; F25D 2317/061; F25D 2317/062; F25D 2323/023

USPC ..... 62/377

See application file for complete search history.

(56) References Cited

U.S. PATENT DOCUMENTS

| | | | | |
|---|---|---|---|---|
| 6,694,770 | B2 | 2/2004 | Winders et al. | |
| 6,725,678 | B2 | 4/2004 | Chang et al. | |
| 7,036,334 | B2 | 5/2006 | Ko et al. | |
| 7,059,142 | B2 | 6/2006 | Jeong et al. | |
| 7,644,590 | B2 | 1/2010 | Holmes et al. | |
| 7,971,443 | B2 * | 7/2011 | Nishita | F25D 11/02 62/159 |
| 8,418,485 | B2 | 4/2013 | Nishita et al. | |
| 2007/0074527 | A1 * | 4/2007 | Lee | F25C 5/005 62/344 |
| 2010/0293983 | A1 * | 11/2010 | Kim | F25D 17/065 62/340 |
| 2011/0023528 | A1 * | 2/2011 | Kwon | F25D 23/028 62/441 |
| 2011/0146323 | A1 * | 6/2011 | Choi | F25D 23/04 62/340 |
| 2011/0302950 | A1 * | 12/2011 | Hawkins | F25D 17/065 62/344 |
| 2012/0031129 | A9 * | 2/2012 | Tarr | F25D 11/025 62/180 |

* cited by examiner

*Primary Examiner* — Jonathan Bradford
(74) *Attorney, Agent, or Firm* — Dority & Manning, P.A.

(57) ABSTRACT

Refrigerator appliances are provided. A refrigerator appliance includes a cabinet defining a fresh food chamber, and a door rotatably hinged to the cabinet for accessing the fresh food chamber, the door including an inner surface and an outer surface. The refrigerator appliance further includes a compartment defined in the inner surface of the door, the compartment defining an interior chamber and including a compartment door providing access to the interior chamber. The compartment is selectively operable at a first temperature below approximately 32 degrees Fahrenheit and a second temperature above approximately 40 degrees Fahrenheit.

17 Claims, 4 Drawing Sheets

REFRIGERATOR APPLIANCE WITH VARIABLE TEMPERATURE COMPARTMENT

FIELD OF THE INVENTION

The present disclosure related generally to refrigerator appliances, and more particularly to refrigerator appliances which include compartments in fresh food chambers for storing items at various temperatures and temperature ranges.

BACKGROUND OF THE INVENTION

Generally, refrigerator appliances include a cabinet that defines a fresh food chamber for receipt of food items for storage. Many refrigerator appliances further include a freezer chamber for receipt of food items for freezing and storage. In many currently utilized refrigerator appliances, the freezer chamber is positioned below the fresh food chamber. Users of these refrigerator appliances must bend over to reach frozen food items stored in the freezer chamber. This can be detrimental and even painful to users with back issues, etc.

Additionally, many such presently known refrigerator appliances do not include areas which allow for storage of food items above the temperature of the fresh food chamber. Such storage areas may be desired for the storage of wine, certain vegetables, etc.

Accordingly, improved refrigerator appliances are desired. For example, refrigerator appliances which provide storage areas in the fresh food chamber for frozen items, and which provide storage areas in the fresh food chamber for items at higher temperatures including those above that of the fresh food chamber, would be advantageous. In particular, refrigerator appliances with storage areas that facilitate selective storage of frozen items and items at higher temperatures including those above that of the fresh food chamber would be advantageous.

BRIEF DESCRIPTION OF THE INVENTION

Additional aspects and advantages of the invention will be set forth in part in the following description, or may be apparent from the description, or may be learned through practice of the invention.

In accordance with one embodiment, a refrigerator appliance is disclosed. The refrigerator appliance includes a cabinet defining a fresh food chamber, and a door rotatably hinged to the cabinet for accessing the fresh food chamber, the door including an inner surface and an outer surface. The refrigerator appliance further includes a compartment defined in the inner surface of the door, the compartment defining an interior chamber and including a compartment door providing access to the interior chamber. The compartment is selectively operable at a first temperature below approximately 32 degrees Fahrenheit and a second temperature above approximately 40 degrees Fahrenheit.

In accordance with another embodiment, a refrigerator appliance is disclosed. The refrigerator appliance includes a cabinet defining a fresh food chamber and a freezer chamber, and a door rotatably hinged to the cabinet for accessing the fresh food chamber, the door including an inner surface and an outer surface. The refrigerator appliance further includes a compartment defined in the inner surface of the door, the compartment defining an interior chamber and including a compartment door providing access to the interior chamber. The compartment is in fluid communication with the freezer chamber and selectively operable at a first temperature below approximately 32 degrees Fahrenheit and a second temperature above approximately 40 degrees Fahrenheit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
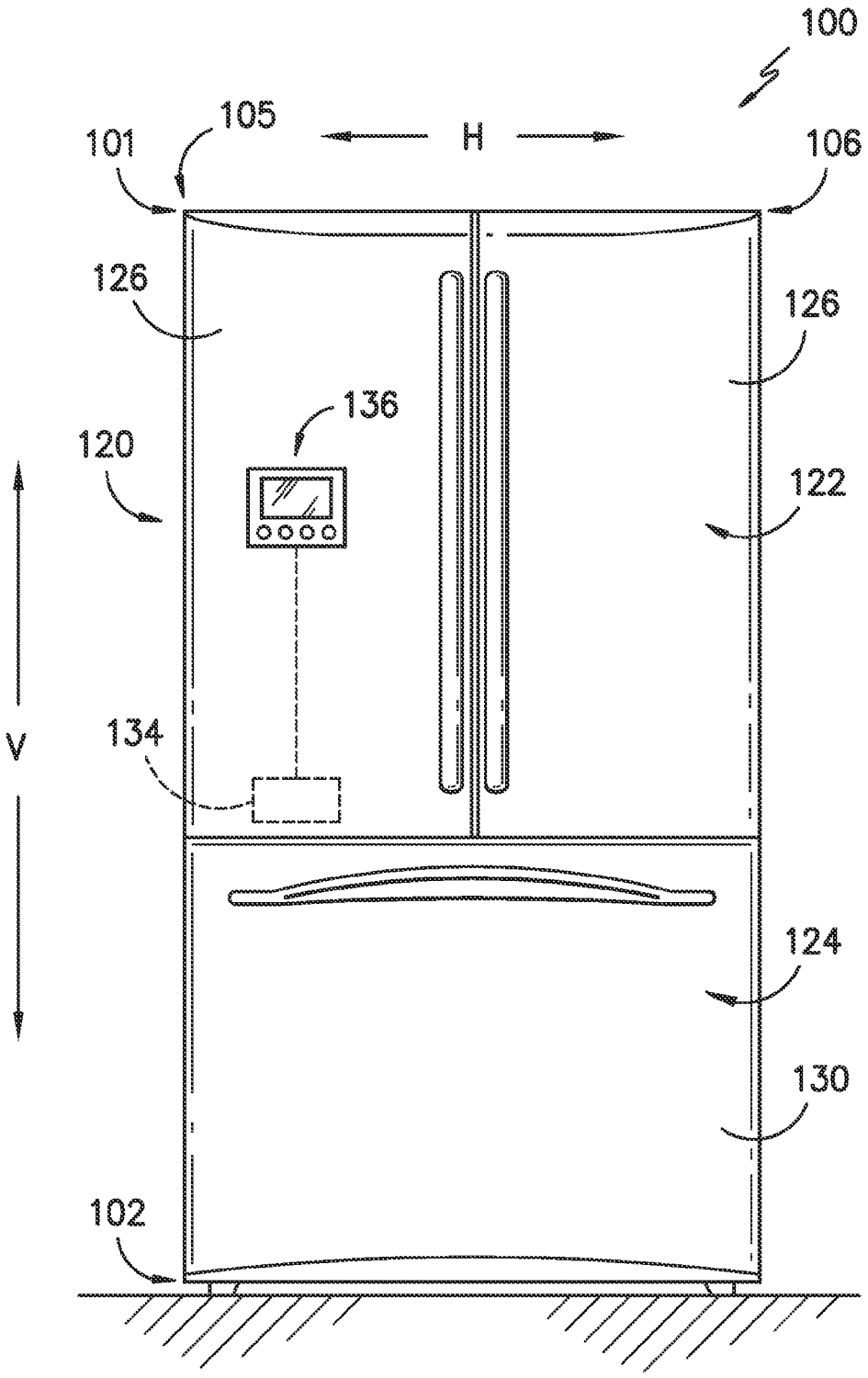
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of an exemplary embodiment of a refrigerator appliance 100. Refrigerator appliance 100 extends between a top 101 and a bottom 102 along a vertical direction V. Refrigerator appliance 100 also extends between a first side 105 and a second side 106 along a horizontal direction H. A transverse direction T may additionally be defined perpendicular to the vertical and horizontal directions V, H.

Refrigerator appliance 100 includes a cabinet or housing 120 defining an upper fresh food chamber 122 and a lower freezer chamber 124 arranged below the fresh food chamber 122 on the vertical direction V. As such, refrigerator appliance 100 is generally referred to as a bottom mount refrigerator. In the exemplary embodiment, housing 120 also defines a mechanical compartment (not shown) for receipt of a sealed cooling system (not shown). Using the teachings disclosed herein, one of skill in the art will understand that the present invention can be used with other types of refrigerators (e.g., side-by-sides) or a freezer appliance as well. Consequently, the description set forth herein is for illustrative purposes only and is not intended to limit the invention in any aspect.

Refrigerator doors 126 are rotatably hinged to an edge of housing 120 for accessing fresh food chamber 122. It should be noted that while two doors 126 in a "french door" configuration are illustrated, any suitable arrangement of doors utilizing one, two or more doors is within the scope and spirit of the present disclosure. A freezer door 130 is arranged below refrigerator doors 126 for accessing freezer chamber 124. In the exemplary embodiment, freezer door 130 is coupled to a freezer drawer (not shown) slidably coupled within freezer chamber 124.

Figure 2:
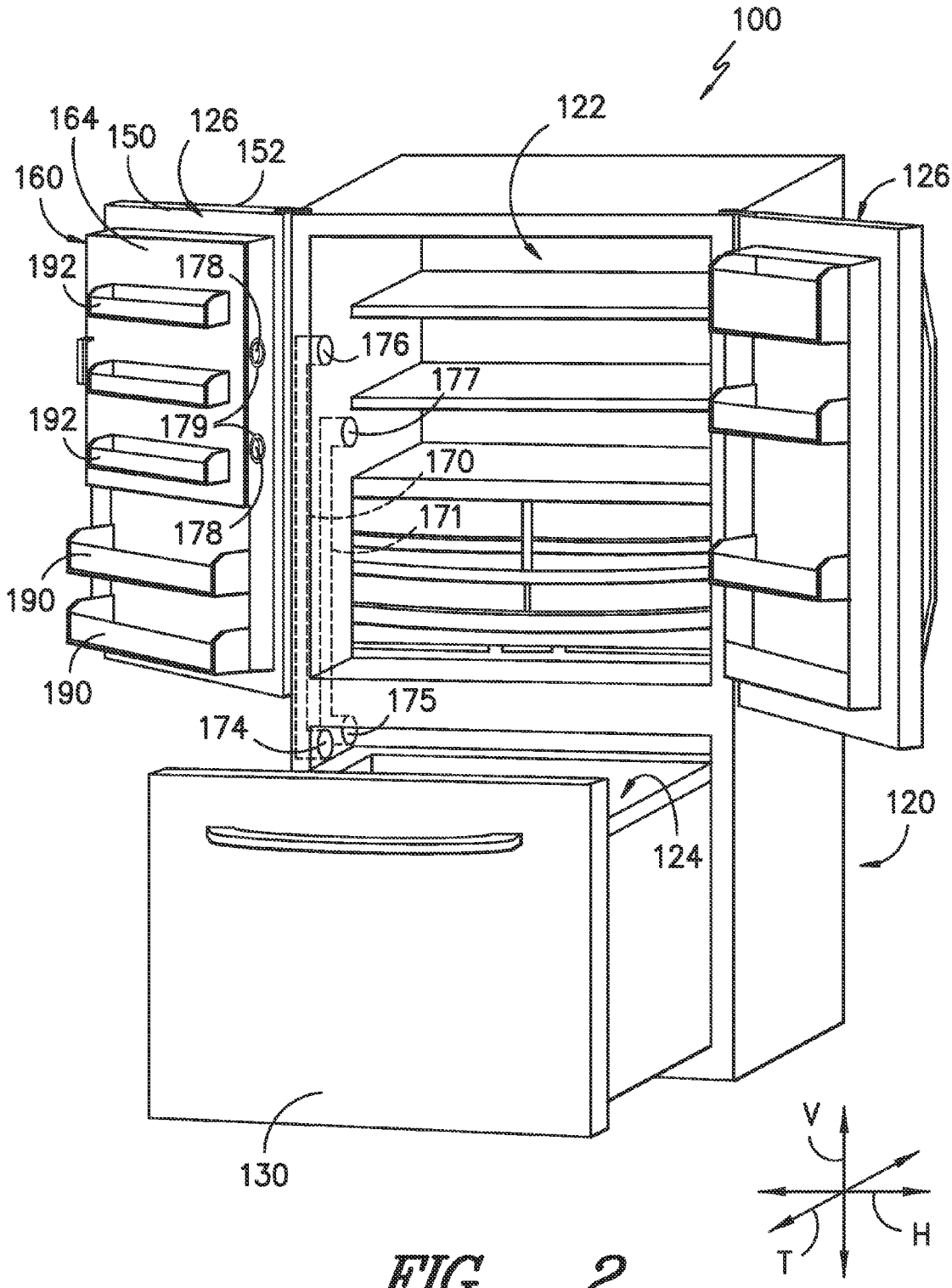
FIG. 2 provides a front view of the refrigerator appliance of FIG. 1 with refrigerator doors of the refrigerator appliance shown in an open configuration to reveal a fresh food chamber and freezer chamber of the refrigerator appliance.

FIG. 2 is a perspective view of refrigerator appliance 100 having refrigerator doors 126 in an open position to reveal the interior of the fresh food chamber 122. Additionally, freezer door 130 is shown in an open position to reveal the interior of the freezer chamber 124.

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections, including those discussed herein, etc. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within the door 126. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller via one or more signal lines or shared communication busses.

Figure 3:
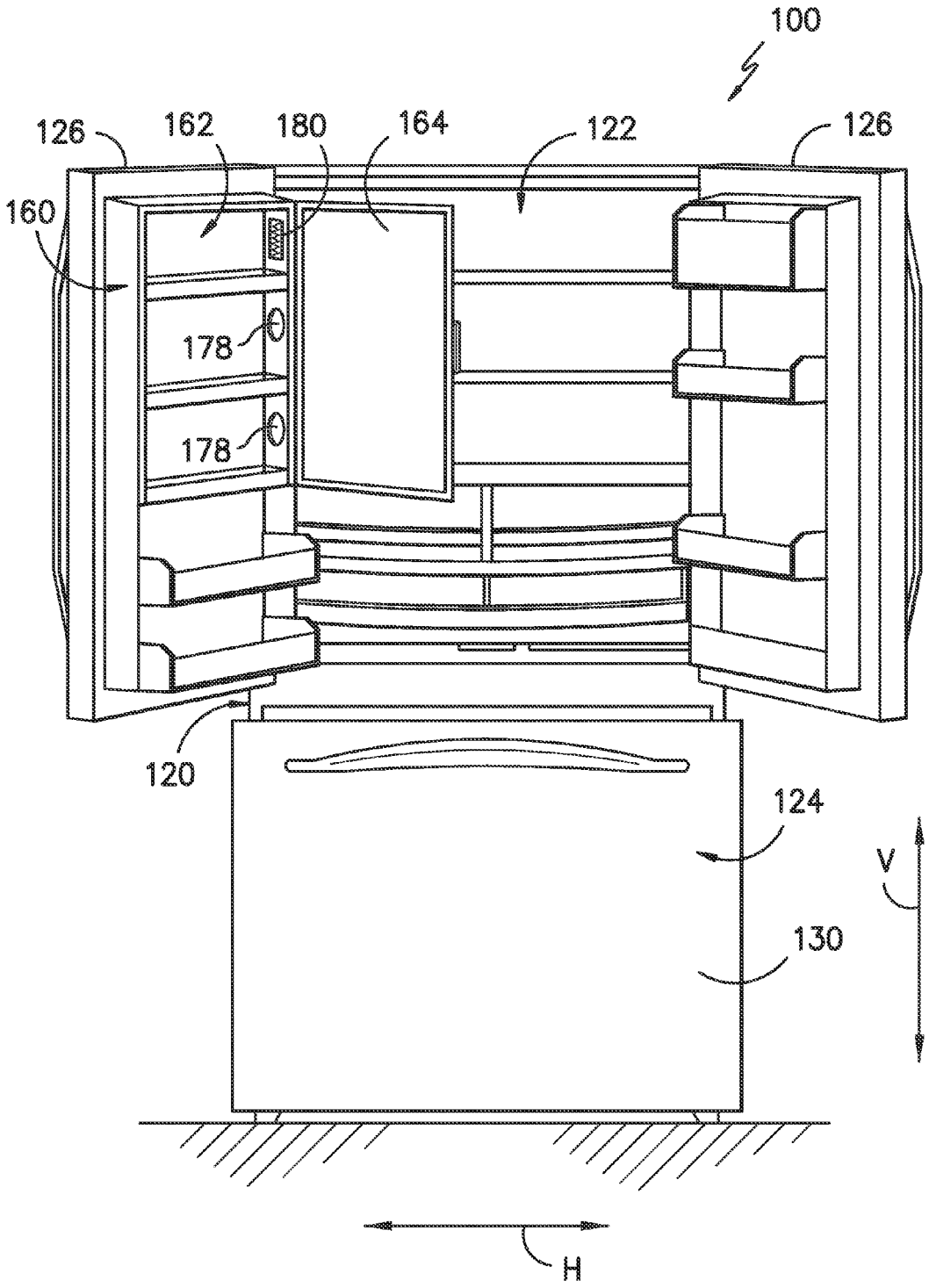
FIG. 3 provides a front view of the refrigerator appliance of FIG. 2 with a compartment door of a compartment in a refrigerator door shown in an open configuration to reveal a compartment of the refrigerator appliance.

Referring now to FIGS. 2 and 3, a door 126 of the refrigerator appliance 100 may include an inner surface 150 and an outer surface 152. The inner surface 150 generally defines the interior of the fresh food chamber 122 when the door 126 is in a closed position as shown in FIG. 1, while the outer surface 152 is generally opposite the inner surface 150 and defines the exterior of the refrigerator appliance 100.

As shown, a compartment 160 may be defined in a door 126, such as in the inner surface 150 of the door 126. The compartment 160 may advantageously, as discussed herein, be configured to contain various items at a wide variety of temperatures, as selected by a user. The compartment 160 may define an interior chamber 162 therein in which such items may be placed, and may further include a compartment door 164 which may provide access to the interior chamber 162. For example, the door 164 may be rotatably hinged to an edge of compartment 160 for accessing the chamber 162, or may otherwise be connected to the compartment 160, door 126, etc., such that the door 164 may be movable between open and closed positions. In a closed position, as shown in FIG. 2, the door 164 may define the interior of the chamber 162 and enclose the chamber 162. In an open position, as shown in FIG. 3, the door 164 may provide access to the interior of the chamber 162.

In general, the compartment 160 and various components thereof, including the chamber 162 and door 164, may be insulated to reduce heat exchange between the compartment 160 and, for example, the fresh food chamber 122. Due to the insulation which encloses insulated compartment 160, the temperature within insulated chamber 162 can be maintained at a variety of levels different from the temperature in the fresh food chamber 122.

Compartment 160 is selectively operable at various temperatures and temperature ranges, including temperatures below and above freezing. In exemplary embodiments, the compartment 160 thus facilitates use with both frozen foods, etc. at below freezing temperatures, as well as food items such as wines, vegetables, etc. which require above freezing temperature which, in some cases, may even be above the temperature of the fresh food chamber 122.

Thus, a compartment 160 according to the present disclosure may be selectively operable at a first temperature below approximately 32 degrees Fahrenheit and a second temperature above approximately 40 degrees Fahrenheit. Further, in some embodiments, the first temperature may be below approximately 0 degrees Fahrenheit, the second temperature may be between approximately 40 degrees Fahrenheit and approximately 60 degrees Fahrenheit, and the compartment 160 may further be selectively operable at a third temperature between approximately 33 degrees Fahrenheit and approximately 38 degrees Fahrenheit. Still further, it should be understood that compartment 160 may be selectively operable at any number of various temperatures and/or temperature ranges as desired or required per application. For example, in some embodiments, the first temperature may be between approximately 0 degrees Fahrenheit and approximately-10 degrees Fahrenheit, the second temperature may be between approximately 42 degrees Fahrenheit and approximately 48 degrees Fahrenheit, the third temperature may be between approximately 33 degrees Fahrenheit and approximately 38 degrees Fahrenheit, and the compartment 160 may further be selectively operable at a fourth temperature between approximately 52 degrees Fahrenheit and approximately 58 degrees Fahrenheit. Various food items may advantageous be stored in compartment 160 at the various temperatures or temperature ranges. For example, frozen items may be stored in compartment 160 when selectively operated at a first temperature, cold beverages may be stored in compartment 160 when selectively operated at a third temperature, white wine may be stored in compartment 160 when selectively operated at a second temperature, and red wine may be stored in compartment 160 when selectively operated at a fourth temperature.

Various components may be utilized to facilitate the wide temperature ranges selectively available in the compartment 160. For example, in one embodiment, compartment 160 may be in fluid communication with the freezer chamber 124. As shown, in FIGS. 3 and 4, for example, a supply duct 170 and a return duct 171 may extend between and provide the fluid communication between the compartment 160 and freezer chamber 124. The duct 170 may, as desired, flow air 172 from the freezer chamber 124 to the compartment 160. The duct 171 may, as desired, flow air 172 from the compartment 160 to the freezer chamber 124. Duct 170 may include, for example, freezer inlet 174 and compartment outlet 176. Duct 171 may include, for example, freezer outlet 175 and compartment inlet 177. Freezer inlet 174 and outlet 175 may be defined in the freezer chamber 124, while compartment inlet 177 and outlet 176 may be defined in the fresh food chamber 126. Ducts 170, 171 may generally be disposed within the refrigerator appliance 100, such as within the various walls defining the chambers 122, 124. When the door 126 is in a closed position, apertures 178 in the compartment 160 may mate with outlet 176 and inlet 177 to allow air flow exhausted from the outlets 176 to enter the compartment 160. Gaskets 179 may prevent air 172 leakage from apertures 178 when the door 126 is in an open position.

Figure 4:
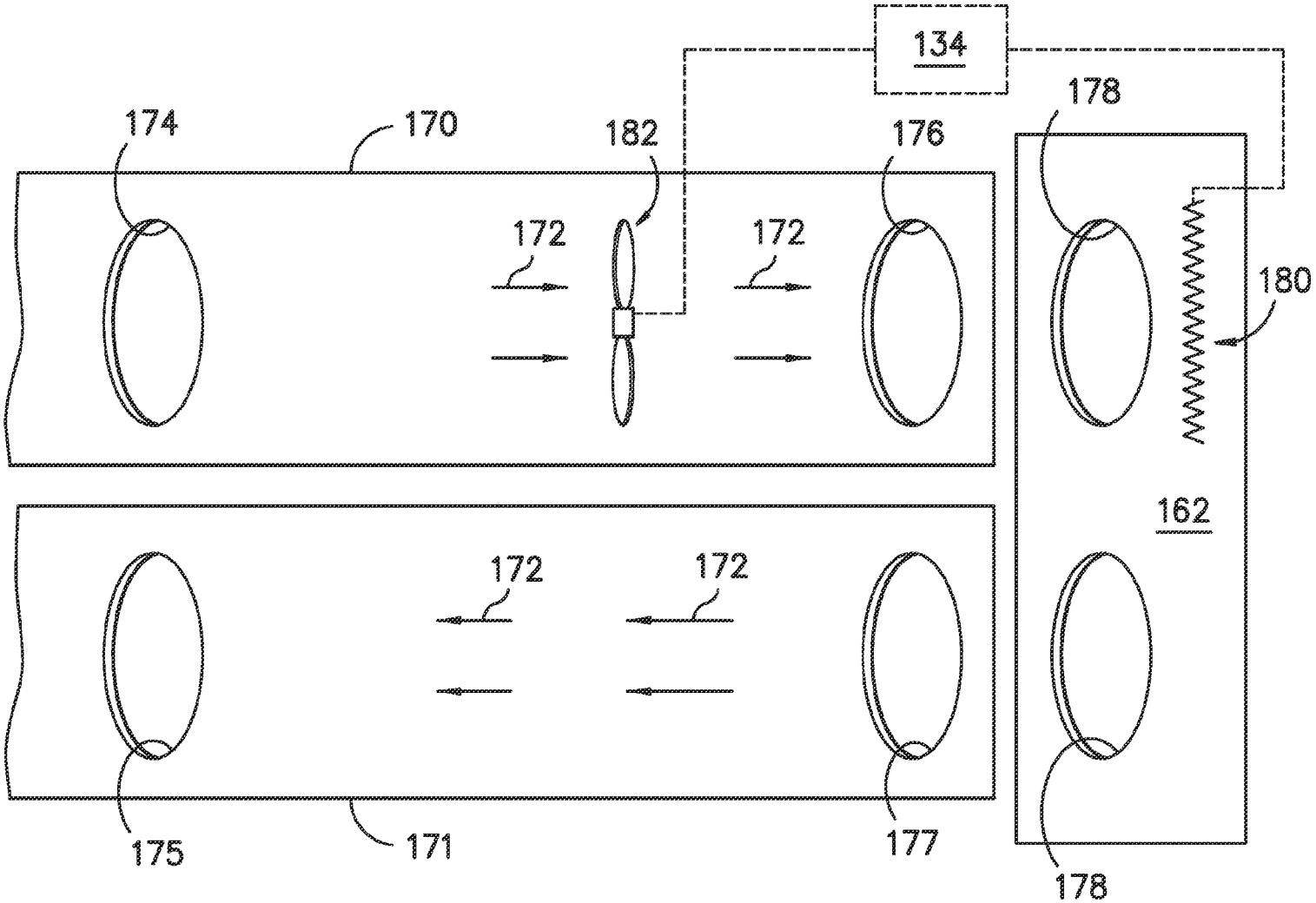
FIG. 4 illustrates a duct extending between a freezer chamber and a compartment in a refrigerator door according to an exemplary embodiment of the present subject matter.

As shown in FIG. 4, in some exemplary embodiments, components such as a thermistor 180 may be disposed in the chamber 162 and a fan 182 may be disposed within duct 170, and the thermistor 180 and fan 182 may be operable to adjust a desired temperature of the compartment 160 to within one of the various temperature ranges discussed above, such as to a first temperature, a second temperature, a third temperature, or a fourth temperature. Such components may be operable to adjust the desired temperature to each temperature/temperature range as the temperature/temperature range is selected per application. Thus, for example, the thermistor may sense a temperature such as that within the chamber 162, and the fan may have an adjustable speed to adjust the amount of air flowed through the duct 170 to the compartment 160, in order to achieve a desired temperature.

As further shown in FIG. 4, controller 134 may in exemplary embodiments be operable to adjust a desired temperature of the compartment 160 to within one of the various temperature ranges discussed above, such as to a first temperature, a second temperature, a third temperature, or a fourth temperature. For example, fan 182 and/or thermistor 180 may be coupled to and thus operatively controlled by controller 134. Still further, as discussed, user input panel 136 may be operably coupled to the controller 134. Thus, controller 134 and various components such as thermistor 180 and fan 182 may be operatively controlled via user input through user input panel 136. For example, a user may select on the user input panel 136 a certain desired temperature setting, such as a first temperature, a second temperature, a third temperature, or a fourth temperature. The controller 134 may then instruct the various other components, such as the fan 182 and/or thermistor 180, to operate to provide such desired temperature. Further, various of the components, such as the thermistor 180, may provide feedback to the controller 134 regarding whether a desired temperature has been achieved.

Additionally or alternatively, with regard to temperatures above the temperature of the freezer chamber 124 and/or the fresh food chamber 122, may be facilitated through heat transfer from ambient exterior to the refrigerator appliance 100 to the interior chamber 162 of the controller 134.

Referring again briefly to FIG. 2, various storage compartments may additionally be available on door 126 exterior to the compartment 160, to contain for example food items to be cooled at the temperature of the fresh food chamber 122. For example, bins 190 may extend from the inner surface 150 of the door 126, and bins 192 may extend from the compartment door 164, such as into the fresh food chamber 122 when the door 126 is in the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:
   a cabinet defining a fresh food chamber and a freezer chamber, the freezer chamber positioned below the fresh food chamber along a vertical direction;
   a door rotatably hinged to the cabinet for accessing the fresh food chamber, the door comprising an inner surface and an outer surface;
   a compartment defined in the inner surface of the door, the compartment defining an interior chamber and comprising a compartment door providing access to the interior chamber, the compartment selectively operable at a first temperature below approximately 32 degrees Fahrenheit and a second temperature above approximately 40 degrees Fahrenheit; and
   a supply duct and a return duct each extending between and providing direct fluid communication between the compartment and the freezer chamber, the supply duct extending between a freezer inlet and a compartment outlet, and the return duct extending between a compartment inlet and a freezer outlet.

2. The refrigerator appliance of claim 1, wherein the compartment is selectively operable at the first temperature below approximately 0 degrees Fahrenheit, the second temperature between approximately 40 degrees Fahrenheit and approximately 60 degrees Fahrenheit, and a third temperature between approximately 33 degrees Fahrenheit and approximately 38 degrees Fahrenheit.

3. The refrigerator appliance of claim 1, wherein the door rotatably hinged to the cabinet is a plurality of doors each rotatably hinged to the cabinet.

4. The refrigerator appliance of claim 1, further comprising a fan disposed in the supply duct and a thermistor disposed in the interior chamber, the fan and thermistor operable to adjust a desired temperature of the compartment to the first temperature or the second temperature.

5. The refrigerator appliance of claim 1, further comprising a controller, the controller operable to adjust a desired temperature of the compartment to the first temperature or the second temperature.

6. The refrigerator appliance of claim 5, further comprising a user input panel operably coupled to the controller.

7. The refrigerator appliance of claim 1, further comprising a bin extending from the inner surface of the door.

8. The refrigerator appliance of claim 1, further comprising a bin extending from the compartment door.

9. A refrigerator appliance, comprising:
   a cabinet defining a fresh food chamber and a freezer chamber, the freezer chamber positioned below the fresh food chamber along a vertical direction;
   a door rotatably hinged to the cabinet for accessing the fresh food chamber, the door comprising an inner surface and an outer surface;
   a compartment defined in the inner surface of the door, the compartment defining an interior chamber and comprising a compartment door providing access to the interior chamber, the compartment in direct fluid communication with the freezer chamber via a freezer inlet operatively connected to a compartment outlet and a freezer outlet operatively connected to a compartment inlet, the compartment selectively operable at a first temperature below approximately 32 degrees Fahrenheit and a second temperature above approximately 40 degrees Fahrenheit.

10. The refrigerator appliance of claim 9, wherein the compartment is selectively operable at the first temperature below approximately 0 degrees Fahrenheit, the second temperature between approximately 40 degrees Fahrenheit and approximately 60 degrees Fahrenheit, and a third temperature between approximately 33 degrees Fahrenheit and approximately 38 degrees Fahrenheit.

11. The refrigerator appliance of claim 9, wherein the door rotatably hinged to the cabinet is a plurality of doors each rotatably hinged to the cabinet.

12. The refrigerator appliance of claim 9, further comprising a supply duct and a return duct each extending between and providing the direct fluid communication between the compartment and the freezer chamber.

13. The refrigerator appliance of claim 12, further comprising a fan disposed in the supply duct and a thermistor disposed in the interior chamber, the fan and thermistor operable to adjust a desired temperature of the compartment to the first temperature or the second temperature.

14. The refrigerator appliance of claim 9, further comprising a controller, the controller operable to adjust a desired temperature of the compartment to the first temperature or the second temperature.

15. The refrigerator appliance of claim 14, further comprising a user input panel operably coupled to the controller.

16. The refrigerator appliance of claim 9, further comprising a bin extending from the inner surface of the door.

17. The refrigerator appliance of claim 9, further comprising a bin extending from the compartment door.

* * * * *